United States Patent [19]

Bateman

[11] 4,418,317

[45] Nov. 29, 1983

[54] LOGARITHMIC AMPLIFIER UTILIZING POSITIVE FEEDBACK

[75] Inventor: Glenn Bateman, Aloha, Oreg.

[73] Assignee: Tektronix, Inc., Beaverton, Oreg.

[21] Appl. No.: 264,521

[22] Filed: May 18, 1981

[51] Int. Cl.[3] ..... G06G 7/24

[52] U.S. Cl. ..... 328/145; 307/492

[58] Field of Search ..... 307/492, 350, 362, 363, 307/359, 491; 328/145

[56] References Cited

U.S. PATENT DOCUMENTS

| | | | |
|---|---|---|---|
| 3,254,304 | 5/1966 | Barret | 307/491 |
| 3,562,550 | 2/1971 | Fein | 307/492 |
| 3,992,622 | 11/1976 | Numata et al. | 328/145 X |
| 4,236,126 | 11/1980 | Weller et al. | 307/491 |
| 4,259,641 | 3/1981 | Carow | 307/350 |
| 4,323,798 | 4/1982 | Watkins | 307/491 |

*Primary Examiner*—John S. Heyman
*Assistant Examiner*—Timothy P. Callahan
*Attorney, Agent, or Firm*—John Smith-Hill; John D. Winkelman

[57] ABSTRACT

A non-linear amplifier circuit that may be used to provide a logarithmic amplification characteristic. The circuit includes an amplification stage employing positive non-linear feedback for low level input signals to reduce the input capacitance of the amplifier. For large level input signals the feedback is eliminated.

6 Claims, 1 Drawing Figure

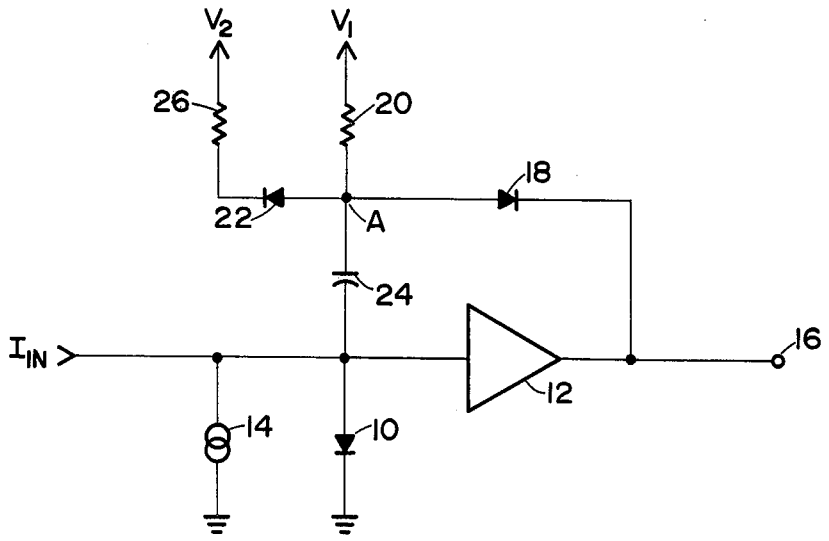
V2
V1
26
20
18
22
A
24
IIN
16
12
14
10

LOGARITHMIC AMPLIFIER UTILIZING POSITIVE FEEDBACK

BACKGROUND OF THE INVENTION

This invention relates generally to non-linear amplifiers and, more particularly, to logarithmic amplifiers employing a single amplifier stage with positive non-linear feedback. Logarithmic amplifiers are often used in applications where there is a need to compress an input of large dynamic range into an output of small dynamic range. One means for providing the logarithmic relationship is to use a logarithmic detector, constructed from a properly biased diode matrix, and driven by a linear amplifier. Another technique is to design an amplifier that has high gain at low input levels and low gain at high input levels, thus producing a logarithmic input-output relationship.

One example of a logarithmic amplifier with a high gain at low input levels and low gain at high input levels can be found in U.S. Pat. No. 3,646,456, issued to Kauffman et al., and assigned to the assignee of the present invention. Kauffman employs a plurality of non-linear amplifier stages connected in cascade. The gain of each stage is initially greater than unity and is reduced to unity upon switching of an input limiter to a high-impedance state when the input signal exceeds a predetermined amplitude.

SUMMARY OF THE INVENTION

According to the present invention, a logarithmic amplifier circuit utilizes an amplifying stage selectively employing positive non-linear feedback. A non-inverting amplifier has a non-linear element connected to the input thereof. A feedback network coupled from the output of the amplifier to the input includes a pair of diodes biased to provide maximum feedback for small input signal levels and no feedback for large input signals.

One feature of the present invention is to provide an improved non-linear amplifier having a high bandwidth, wide dynamic range and low noise.

Another feature of the present invention is to provide a logarithmic amplifier employing a single amplifier stage utilizing positive non-linear feedback.

Yet another feature of the present invention is to provide a logarithmic amplifier circuit in which positive non-linear feedback is controlled by a pair of biased diodes connected in opposition.

These and other features of the present invention will be more readily understood by those skilled in the art from a reading of the following detailed specifications and drawing.

BRIEF DESCRIPTION OF THE DRAWING

The single FIGURE is a schematic diagram of the preferred embodiment in accordance with the present invention.

DETAILED DESCRIPTION OF THE PREFERRED EMBODIMENT

The single FIGURE shows a logarithmic amplifier in which a logarithmic circuit selectively provides positive non-linear feedback. The anode of diode 10 is connected to the input of non-inverting amplifier 12. The cathode of diode 10 is connected to ground. Also connected to the input of amplifier 12 is constant current source 14, the other side of which connects to ground potential.

The output of amplifier 12 is connected to output terminal 16. Additionally, the output of amplifier 12 connects to the cathode of diode 18, the anode of which connects to junction A. Also connected to junction A is resistor 20, the other side of which connects to positive supply source $V_1$, the anode of diode 22, and one side of capacitor 24. The other side of capacitor 24 connects to the input of amplifier 12. The cathode side of diode 22 connects to resistor 26, the other side of which is coupled to voltage source $V_2$. Diode 22 provides temperature compensation for the amplifier circuit.

A constant-current driven, diode-controlled logarithmic amplifier has an excellent logarithmic response for input currents above the value of the current from the constant current source. However, for very small input current values the rise time of the amplifier is degraded. Such rise-time degradation is due to the capacitance and resistance associated with the input of the amplifier, and serves to reduce the overall bandwidth of the amplifier.

In operation of the logarithmic amplifier circuit illustrated in the Figure, diode 10 provides a logarithmic voltage-current characteristic. The value of the current from constant-current source 14 determines the lower end bandwidth of logarithmic amplifier 12 by setting the impedance of diode 10. In a quiescent condition, the current through diode 10 is equal to the current from constant current source 14, and diode 18 and diode 22 are biased "on" by voltage source $V_1$. Additionally, the voltage potential from voltage source $V_2$ is set to provide equal currents through diode 18 and diode 22 in the quiescent condition.

For input signals in the range where the input current $I_{in}$ is less than the current supplied by constant current source 14, positive non-linear feedback is provided by way of capacitor 24 and the conduction of diodes 18 and 22. The positive non-linear feedback operates to reduce the input capacitance of amplifier 12 for low level input signals, thereby maintaining the bandwidth of the amplifier. When the input current $I_{in}$ increases to values in excess of the output current from constant current source 14, diode 18 becomes reverse biased and eliminates the positive feedback. At input current levels that exceed the current from source 14, the impedance of diode 10 is reduced and positive feedback is no longer needed to maintain the amplifier's bandwidth.

The logarithmic amplifier circuit illustrated in the Figure thus selectively utilizes positive feedback supplied by way of conducting diode 18 and feedback capacitor 24 to reduce the input capacitance of amplifier 12 for input current values less than the value of the current from constant current source 14. For input current values greater than the current from constant current source 14, diode 18 becomes reverse biased and shuts off the positive feedback. In operation the thus-controlled feedback provides a logarithmic amplifier circuit with a wide bandwidth, avoiding the instabilities normally associated with positive feedback.

Thus, there has been described and illustrated herein a system in accordance with the present invention to provide a logarithmic amplifier circuit with wider bandwidth, lower noise and wide dynamic range. It will be obvious to those having skill in the art that many changes may be made in the above-described details of the preferred embodiment without departing from the spirit of the invention.

I claim:

1. A non-linear amplifier, comprising:

an amplifier stage having an input and an output;

a non-linear element coupled between said input and a reference potential level;

a constant current source coupled to said input; and a feedback network coupled from said output to said input for providing positive feedback from said output to said input when the input signal is less than a predetermined value.

2. An amplifier according to claim 1, wherein the feedback network comprises a diode having a cathode which is connected to said output and also having an anode, and a capacitor connected between the anode of said diode and said input, and the amplifier further comprising voltage source means connected to the anode of the diode whereby the diode is forward biased when the amplifier input signal is less than said predetermined value and reverse biased when the amplifier input signal is greater than said predetermined value.

3. An amplifier according to claim 2, wherein the potential of said voltage source means is such that said predetermined value is substantially equal to the value of the output current from said constant current source.

4. An amplifier according to claim 1, further comprising a circuit element connected to the feedback network for providing temperature compensation to said amplifier.

5. An amplifier according to claim 4, further comprising a voltage source, and wherein the feedback network comprises a diode having a cathode which is connected to said output and also having an anode, and a capacitor connected between the anode of said diode and said input, and wherein the temperature compensation circuit element comprises a second diode having an anode which is connected to the anode of the first diode and having a cathode which is connected to said voltage source.

6. An amplifier according to claim 5, further comprising a second voltage source connected to the anodes of the first and second diodes, the relative potentials of the voltage sources establishing equal current flow through the two diodes when no input signal is applied to said amplifier.

* * * * *